US005253925A

United States Patent [19]

Modzik, Jr.

[11] Patent Number: 5,253,925

[45] Date of Patent: Oct. 19, 1993

[54] METHOD AND APPARATUS FOR COLLECTING AND REMOVING DUST ON A MINING MACHINE

[75] Inventor: Andrew E. Modzik, Jr., Morgantown, W. Va.

[73] Assignee: Tamrock World Corporation, N.V., Curacao, Netherlands Antilles

[21] Appl. No.: 822,077

[22] Filed: Jan. 17, 1992

[51] Int. Cl.[5] ..... F21C 35/22; F21F 5/02

[52] U.S. Cl. ..... 299/12; 55/257.2; 299/64

[58] Field of Search ..... 299/12, 64, 18; 55/257.2; 261/DIG. 54

[56] References Cited

U.S. PATENT DOCUMENTS

| | | | |
|---|---|---|---|
| 2,375,689 | 5/1945 | Reeder | 299/7 |
| 3,712,678 | 1/1973 | Amoroso | 299/68 |
| 4,076,315 | 2/1978 | Gundlach et al. | 299/64 |
| 4,193,778 | 3/1980 | Strahsner et al. | 55/238 |
| 4,225,188 | 9/1980 | McGuire et al. | 299/64 |
| 4,249,778 | 2/1981 | McGuire | 299/64 |
| 4,289,509 | 9/1981 | Holter | 55/257.2 |
| 4,380,353 | 4/1983 | Campbell et al. | 299/12 |
| 4,388,087 | 6/1983 | Tipton | 55/96 |
| 4,869,737 | 9/1989 | Parenti | 55/213 |
| 4,954,148 | 9/1990 | Alexander | 55/257.2 X |

*Primary Examiner*—David J. Bagnell
*Attorney, Agent, or Firm*—Stanley J. Price, Jr.

[57] ABSTRACT

A first duct system extends longitudinally on one side of a mining machine frame from an air inlet adjacent to a cutter drum carried on a boom rearwardly to an air outlet at the rearward end of the machine frame. A fan assembly is mounted on the machine frame adjacent the inlet and induces flow of dust laden air generated during the material dislodging operation into the first duct system. A scrubber and demister positioned in the first duct system upstream of the air outlet remove the dust particles from the airflow through the duct system for discharge of the airflow from the air outlet substantially free of dust particles. A second duct system is positioned parallel to the first duct system on the opposite side of the machine and extends rearwardly from an air inlet to a crossover point where a transverse duct connects the first and second duct systems. The airflow in the first duct system induces flow of dust laden air into the second duct system and therethrough into the transverse duct and into the first duct system. A discharge duct is connected to the outlet of the first duct system and extends across the rearward end of the machine to a discharge outlet for selective discharge of cleaned air from either side of the machine.

22 Claims, 3 Drawing Sheets

METHOD AND APPARATUS FOR COLLECTING AND REMOVING DUST ON A MINING MACHINE

BACKGROUND OF THE INVENTION

1. Field of the Invention

This invention relates to a mining machine, and more particularly to a scrubber system for dust control on a mining machine in which a duct assembly is provided with fan assemblies mounted upstream of a scrubber, a demister positioned downstream of the scrubber, and a rear crossover discharge duct.

2. Description of the Prior Art

In underground mining, mining machines having a material dislodging means positioned on the front end of the mining machine for dislodging material from a mine face are well known. The dislodged material is conveyed by a conveying system extending rearwardly on the mining machine. The mining machine advances into the mine face to dislodge material to form an entry or tunnel in the material seam. It is also well known in underground mining to provide a mining machine with a dust collection system, and various types of mining machines having different types of duct assemblies are known.

U.S. Pat. No. 2,375,689 discloses an apparatus for the removal of coal from a vein by grinding the vein of coal into a powder and removing the powdered coal by suction. A rotary grinding wheel is positioned against the vein of coal and the resultant powdered coal is withdrawn by means of a suction source.

U.S Pat. No. 4,076,315 discloses a dust collecting system for use in conjunction with a continuous mining machine which includes a duct assembly having an opening adjacent the material dislodging means of the continuous mining machine. The duct assembly has within it a fan assembly, the blades of which are wetted while inducing a flow of air through an opening in the duct assembly adjacent the mining machine material dislodging means. The fan blades also act as a scrubber by means of the impingement of the particles of dust in the air upon the wetted fan blades. The resultant cleaned air and coal slurry is redirected to the mining machine material dislodging means to further reduce dust concentration.

U.S. Pat. No. 4,193,778 discloses a gas scrubber with a plurality of venturi tubes having upstream ends communicating with the air inlet and being arranged parallel to each other. A centrifugal separator is in communication with the downstream ends of the venturi tubes. A blower means for drawing dust laden air into the upstream ends of the venturi tubes and from there into a centrifugal separator is also disclosed. Water is introduced into the venturi tubes in a mist by means of a nozzle. A funnel which widens in the air flow direction and which has a porous air filter across the outlet end of the funnel discharges the cleaned air.

U.S. Pat. No. 4,289,509 discloses a dust collecting system which includes a fan assembly for withdrawing air from the mine face and into a ductwork assembly. Upstream from the fan is an agglomerating chamber wherein the dust-entrained air is wetted. The dust particles are suspended in water droplets in the air. As the water droplets impringe upon a series of vanes they are separated from the air.

U.S. Pat. No. 4,380,353 discloses a dust collecting system comprising a ductwork assembly extending along one side of a continuous mining machine and having an opening adjacent the material dislodging means of the mining machine. A vane axial fan is located in the duct assembly at the rear end of the mining machine, and a scrubber is located upstream of the fan assembly. Between the scrubber and the fan assembly is a demister with an associated sump.

U.S. Pat. No. 4,388,087 discloses a filter for the separation of particulate matter from a flowing gas stream. A cyclone type separator-filter unit is provided with a centrifugal blower integrally mounted to the unit to induce a vacuum within the entire unit. Pleated paper filter elements are utilized as secondary barrier filters.

U.S. Pat. No. 4,869,737 discloses a vehicle for use in conjunction with a conventional coal mining machine. The vehicle has a frame and wheels and is designed to work closely with the coal mining machine to clean dust entrained air produced by the material dislodging means of the mining machine. The vehicle has an air inlet connected to a plurality of individual centrifugal filters which open into a separator core element. The air then passes into a plurality of individual filters by means of a main suction blower.

Although the prior art discloses gas filtering systems and mining machines having dust collecting systems, there remains a need for a mining machine having a dust collection system with a fan assembly mounted upstream of the scrubber and demister of the dust collection system to efficiently utilize the space otherwise occupied by the fan assembly at the rear of the mining machine frame. Further, there is need to reduce the overall length of the mining machine as presently encountered with a rear crossover portion of a duct assembly extending behind the bumper at the rearward end of the mining machine.

SUMMARY OF THE INVENTION

In accordance with the present invention, there is provided a mining machine that includes a mobile frame having a front end portion and a rearward end portion. Dislodging means is mounted on the mobile frame front end portion for dislodging material from a mine face. Conveying means is positioned on the mobile frame for conveying dislodged material rearwardly of the mine face. Duct means extend longitudinally on the mobile frame for directing a flow of airborne dust from the front end portion to the rearward end portion. The duct means has an inlet adjacent to the front end portion and an outlet adjacent to the rearward end portion. A fan assembly is mounted on the mobile frame and is positioned adjacent to the duct means inlet and is operable to induce flow of airborne dust through the duct from the inlet to the outlet. Collection means for removing dust from the flow of airborne dust through the duct means is positioned on the mobile frame adjacent to the outlet so that air is discharged from the duct means substantially free of airborne dust.

Further, in accordance with the present invention there is provided a method for removing airborne dust from a mine face during a mining operation that includes the steps of dislodging material from a mine face. The dislodged material is conveyed rearwardly from the mine face on a mining machine. A duct system positioned on the mining machine extends longitudinally from an inlet adjacent to the mine face to an outlet adjacent to a rearward portion of the mining machine. A fan is mounted on the mining machine adjacent to the inlet to the duct system. A scrubber device is mounted on the mining machine adjacent to the outlet to the duct system. The fan induces a flow of airborne dust into the inlet of the duct system and through the duct system to the scrubber device. The dust particles are separated from the flow of air in the scrubber device. The dust particles are collected on the mining machine for disposal. The scrubber device discharges the air substantially free of dust particles.

Additionally, the present invention is directed to a dust collecting system on a mining machine that includes a machine frame having a front end portion and rearward end portion. Means is carried at the frame front end portion for dislodging material from a mine face. Means is provided for gathering and conveying the dislodged material rearwardly on the machine frame. A first duct assembly is positioned on one side of the machine frame to extend from the front end portion to the rearward end portion. An intake into the first duct assembly is located adjacent the front end portion. An exhaust end of the first duct assembly is located adjacent to the rearward end portion. A first fan is positioned on the machine frame adjacent to the intake end for inducing a flow of dust laden air into the first duct assembly and directing the flow therethrough to the exhaust end. Scrubber means is positioned at the frame rearward end portion for receiving the flow of dust laden air adjacent to the exhaust end and separating dust particles from the flow of air for discharge of the air substantially free of dust particles from the exhaust end. A second duct assembly is positioned on an opposite side of the machine frame. The second duct assembly has an intake end located adjacent to the front end portion. A crossover duct assembly connects the first and second duct assemblies. The crossover duct assembly extends transversely on the machine frame from the second duct assembly to the first duct assembly between the intake and the exhaust end thereof so that the flow of dust laden air through the first duct assembly induces flow of dust laden air into and through the second duct assembly and through the crossover duct assembly into the first duct assembly.

Accordingly, a principal object of the present invention is to provide a mining machine having a duct assembly with a fan assembly mounted on the mining machine adjacent the intake to the duct assembly to induce a flow of dust laden air into the duct assembly and rearwardly to a scrubber device that substantially removes the dust particles from the airflow and discharges the air substantially free of dust particles from an exhaust end of the duct assembly.

Another object of the present invention is to provide method and apparatus on a mining machine for collecting dust laden air generated during the mining operation at the mine face by inducing flow of dust laden air into a duct system positioned on opposite sides of the mining machine where fans at the inlets to the duct system draw the dust laden air into the duct system and convey the air to a scrubber device located rearwardly on the mining machine where the dust particles are substantially removed from the air and the cleaned air is discharged from a selected side of the mining machine.

A further object of the present invention is to provide dust removal apparatus on a mining machine where fans mounted on the mining machine at the inlets to a duct system induce flow of dust laden air into the duct system and direct the airflow through the duct system rearwardly on the mining machine to a scrubber device which substantially removes the dust particles from the airflow and a rearward crossover duct provides for selective discharge of the cleaned air from either side of the mining machine.

Another object of the present invention is to provide a dust collection and removal system on a mining machine that includes a combination of air ducts extending longitudinally on opposite sides of the machine frame and connected by a crossover duct so that dust laden air is gathered at the front end of the mining machine and conveyed rearwardly on the mining machine to a scrubber where the dust particles are substantially removed and a discharge duct extending transversely beneath the operator's compartment permits selective discharge of the cleaned air to either side of the mining machine to provide a compact ventilation system that does not extend the overall length of the mining machine.

These and other objects of the present invention will be more completely disclosed and described in the following specification, the accompanying drawings, and the appended claims.

DESCRIPTION OF THE PREFERRED EMBODIMENTS

Figure 1:
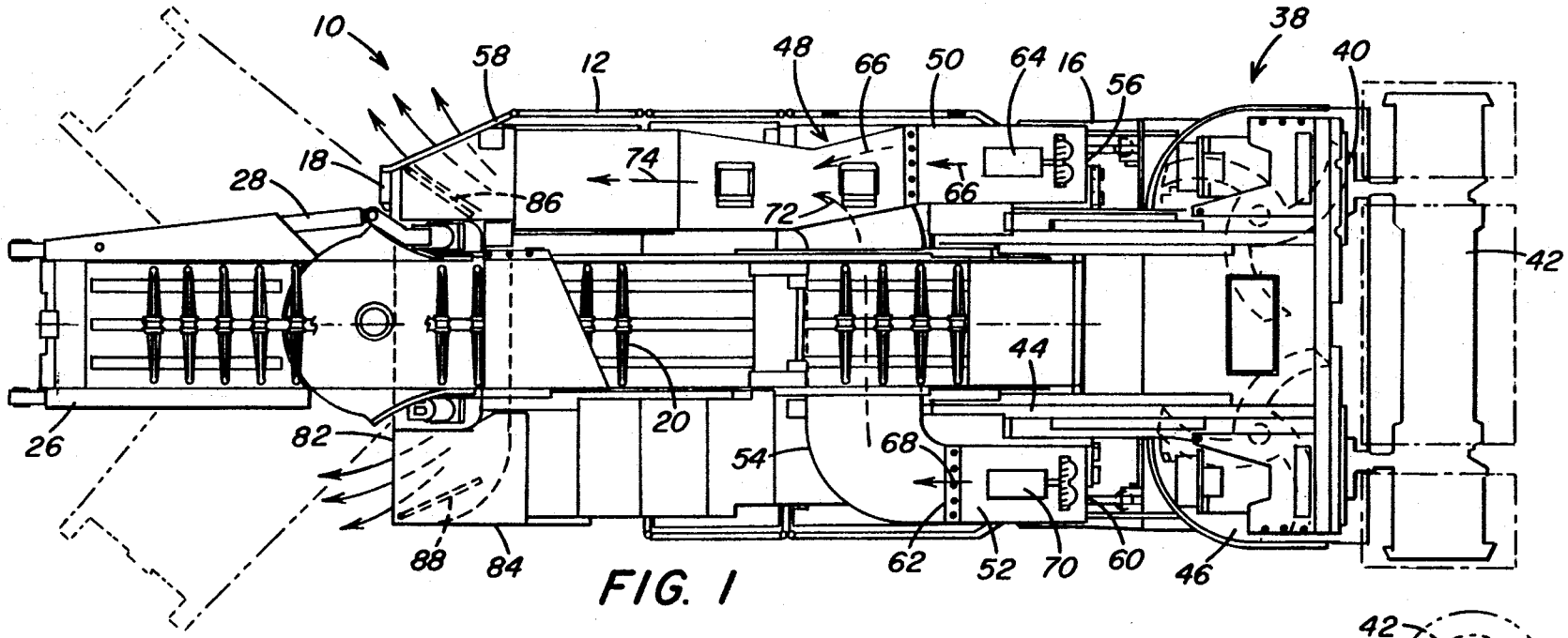
FIG. 1 is a top plan view of a mining machine, illustrating a dust collecting system extending longitudinally on the machine frame with fans located at the intake ends of air ducts for inducing flow rearwardly to a scrubber unit from which the cleaned air is selectively discharged from opposite sides of the mining machine.
Figure 2:
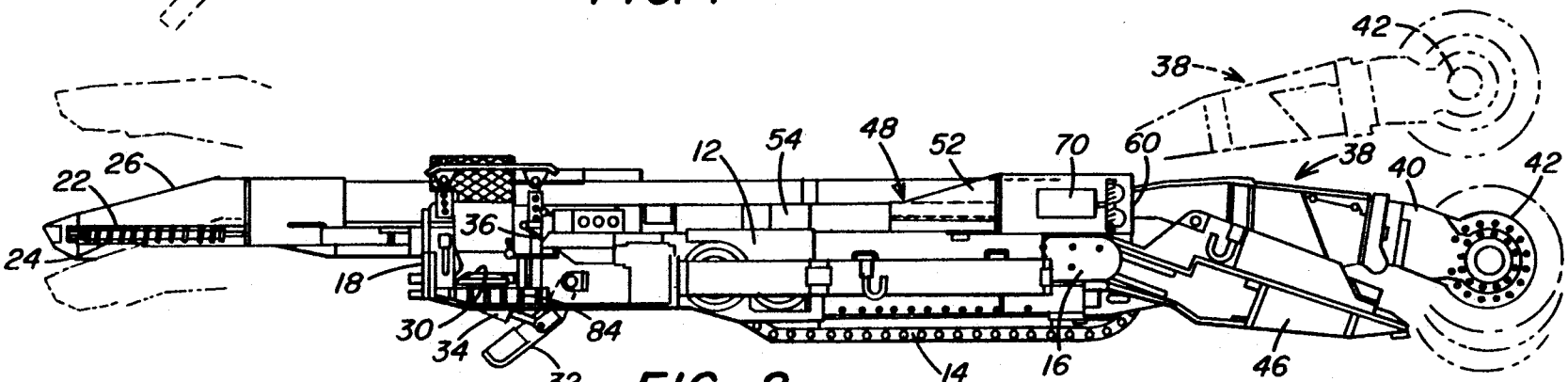
FIG. 2 is a view in side elevation of the mining machine shown in FIG. 1, illustrating a duct intake end provided with a fan and a duct exhaust end extending beneath the operator's compartment.

Referring to the drawings and particularly to FIGS. 1 and 2, there is illustrated a continuous mining machine generally designated by the numeral 10 for use in underground mining to dislodge material from a mine face. The mining machine 10 includes a mobile frame 12 mounted on a pair of ground engaging traction devices 14 positioned on each side of the mobile frame 12 for propelling the mining machine 10 within a mine. The frame 12 includes a front end portion 16 and a rearward end portion 18.

A continuous chain-type conveyor 20 extends longitudinally on the frame 12 from the front end portion 16 to the rearward end portion 18. The chain-type conveyor 20 includes an upper reach 22 and a lower reach 24, as illustrated in FIG. 2. The continuous conveyor 20 is rotatably supported at its opposite end portions and is driven to transport mined material rearwardly on the machine from the frame front end portion 16 to the rearward end portion 18.

At the rearward end portion 18, the conveyor 20 includes a conveyor discharge end portion 26 that is laterally pivoted upon actuation of a piston cylinder assembly 28 that is connected at one end to the machine frame 12 and at an opposite end to the conveyor discharge end portion 26. With this arrangement, the dislodged material is transported by the conveyor 20 to the frame rearward end portion 18 and discharged in a preselected direction from the mining machine 10 as determined by the pivotal position of the conveyor discharge end portion 26 as indicated in phantom in FIG. 1.

The mining machine 10 includes an operator's compartment 30, as seen in FIG. 2, located at the frame rearward end portion 18 laterally of the conveyor 20. Also as seen in FIG. 2, a ground engaging stabilizing device 32 is pivotally connected to the frame rearward end portion 18 to move into and out of engagement with the mine floor or ground to stabilize the mining machine frame 12 during the material dislodging operation. A piston cylinder assembly 34 is connected to the stabilizing device 32 for raising and lowering the device 32 out of and into contact with the mine floor.

The mining machine 10 is also capable of being operated from a remote control station, as known in the art, to dislodge material from a mine face and transport the material rearwardly on the conveyor 20. The mining machine 10 includes in the operator's compartment 30 controls 36 for operating the mining machine, for example, operation of the electric motors for the traction devices 14, the conveyor 20, the material dislodging device, and other equipment on the mining machine 10.

The mining machine 10 includes a boom assembly generally designated by the numeral 38 secured to the front end portion 16 of mobile frame 12. The boom assembly 38 includes a front end portion 40 for rotatably supporting a cutter drum 42 and a rearward end portion 44 which is pivotally connected to the mining machine frame 12. Piston cylinder assemblies (not shown) are pivotally connected to the boom assembly 38 and the mobile frame 12 to pivot the boom assembly 38 through a vertical plane between a lower position and an upper position as illustrated in FIG. 2. In this manner, upward and downward shear cuts of the mine face are executed to dislodge solid material from the mine face. Also, the mining machine 10 is operable to advance into the mine face with the boom assembly 38 in the upper position, as illustrated in phantom in FIG. 2.

The material dislodged by the cutter drum 42 is fed onto a gathering device generally designated by the numeral 46 that extends forwardly from the machine frame 12 in underlying position with the boom assembly 38. As the mining machine 10 advances forwardly, the dislodged material is gathered and fed onto the gathering device 46. The gathering device 46 extends forwardly from the receiving end of the conveyor 20 so that the dislodged material is transferred from the gathering device 46 onto the conveyor 20 and transported rearwardly on the machine frame 12 to the conveyor discharge end portion 26. From the conveyor discharge end portion 26 the dislodged material is transported to a suitable haulage device, such as a main haulage belt, shuttle car, loading machine or the like. The details of the boom assembly 38 and the cutter drum 42 are beyond the scope of the present invention and are described in greater detail in U.S. Pat. No. 4,310,199 entitled "Cutter Drum Assembly For A Continuous Mining Machine" which is incorporated by reference.

In accordance with the present invention, a dust collecting device generally designated by the numeral 48 is positioned on the mining machine 10 and extends longitudinally on the frame 12 from the front end portion 16 to the rearward end portion 18. The dust collecting device 48 is operable to remove airborne dust particles produced as the cutter drum 42 dislodges material from the mine face and thereby provides a relatively dust free working environment for the operator of the mining machine 10 and other personnel working at the mine face.

The dust collecting device 48 is mounted on the mobile frame 12 rearwardly of the boom assembly 38. However, it should be understood that the dust collecting system 48 can also be mounted on the boom assembly 38 and provided with a pivot point for upward and downward pivotal movement of one portion of the dust collecting system 48 with the boom assembly 38 relative to the remaining portion of the dust collecting device 48 that is fixed on the machine frame 12.

Figure 3:
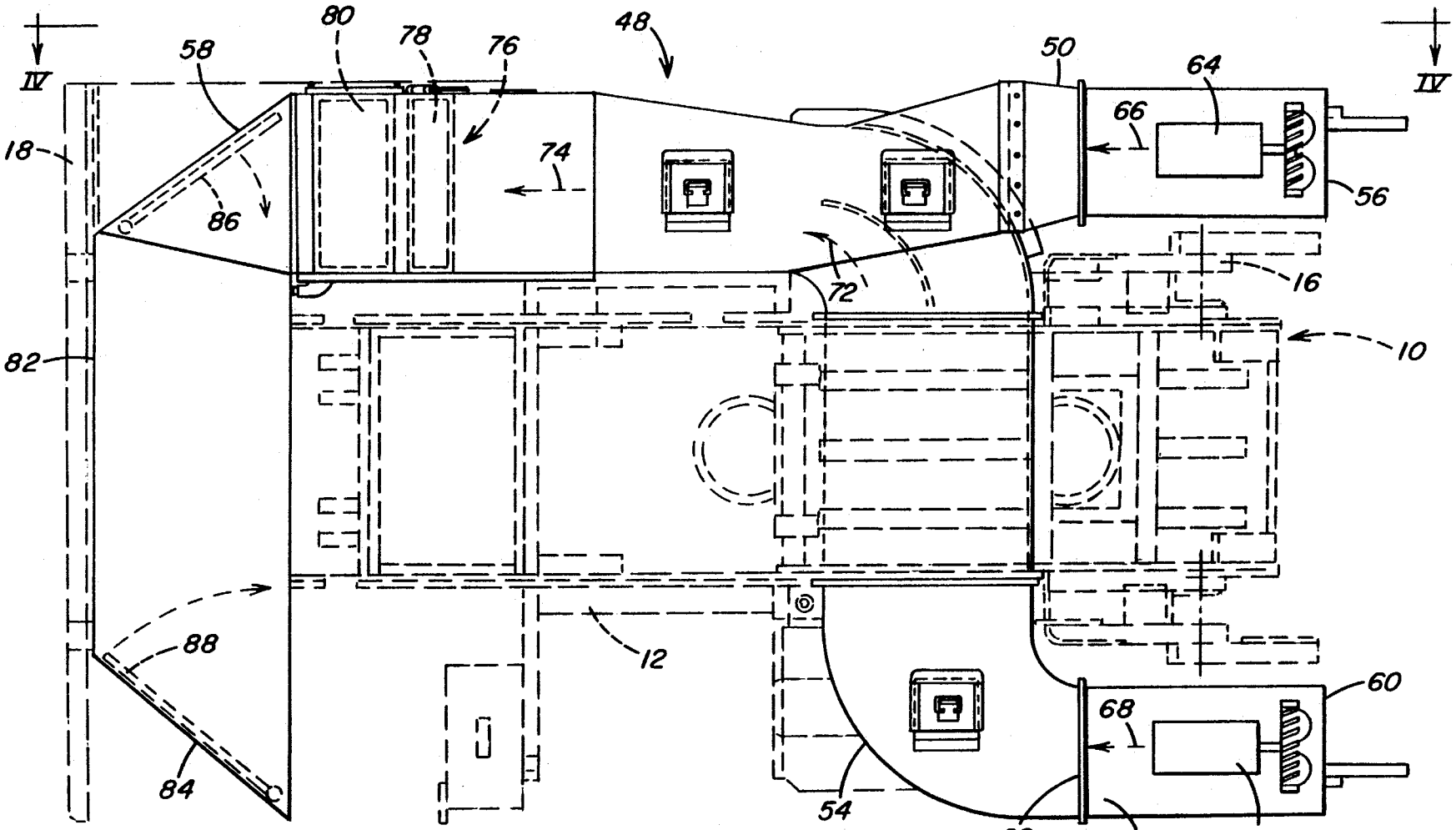
FIG. 3 is a top plan schematic view of the dust collecting system shown in FIGS. 1 and 2 on a mining machine, illustrating a pair of duct sections provided with fans at the intake ends and connected by a crossover duct from which dust laden air is directed to a combination scrubber and demister where the dust particles are removed and the cleaned air is selectively discharged from either side of the machine.

As seen in FIG. 1 and in greater detail in FIG. 3, the dust collecting device 48 includes a duct system for directing dust laden air from the front end portion 16 to the rearward end portion 18 on the mining machine 10. The duct system includes a first portion 50 that extends laterally of and substantially parallel to the conveyor 20 on one side of the mining machine 10 and a second portion 52 that extends partially along the opposite side of the mining machine 10. The duct portions 50 and 52 are connected to one another by a crossover duct portion 54 that extends from the duct portion 52 laterally across the machine frame 12 between the upper conveyor reach 22 and the lower conveyor reach 24 to the first duct portion on the opposite side of the machine frame 12.

The first duct portion 48 has an intake or inlet 56 located rearwardly of and closely adjacent to the boom assembly 38 and an exhaust or outlet 58 at the frame rearward end portion 18 spaced laterally and adjacent to the pivotal connection of the conveyor discharge end portion 26 to the conveyor 20. The second duct portion 52 includes an inlet 60 positioned substantially opposite the first duct portion inlet 56 and an outlet 62 which is connected to and common with the inlet to the crossover duct portion 54. As shown in FIGS. 1 and 3, the connection of the second duct 52 to the crossover duct 54 is substantially intermediate the mining machine frame 12.

It should be understood that the connection of the crossover duct portion 54 to the first and second duct portions 50 and 52 may occur at any point along the length of the first duct portion 50 downstream of the inlet 56 and upstream from the outlet 58. Accordingly, the outlet of the crossover duct portion 54 is integrally connected to the first duct portion 50 so that dust laden air is conveyed from the second duct portion 52 through the crossover duct 54 into the first duct portion 50.

The dust laden air generated at the mine face is directed into the inlet 56 of the first duct portion 50 by a vane-type axial fan assembly 64 mounted at frame front end portion 16. The fan assembly 64 in one arrangement may be mounted within the first duct portion 50 at the inlet 56 thereof or in another arrangement (not shown) removed from the first duct portion 50 and positioned closely adjacent to inlet 56 on the machine frame 12. With both arrangements, the fan assembly 64 is operable to induce flow of dust laden air through the inlet 56 into the first duct portion 50 and therethrough in the direction indicated by the arrows 66. Dust laden air is directed the length of the first duct portion 50 to the outlet 58 thereof.

The airflow past the juncture of the first duct portion 50 with the crossover duct portion 54 generates a venturi effect which induces flow of air into the inlet 60 of second duct portion 52 in the direction indicated by the arrow 68 and through the crossover duct 54. The dust laden air is transferred laterally across the mining machine frame 12 to the point where the crossover duct 54 is connected in fluid communication with the first duct portion 50. Thus the flow of dust laden air drawn into the second duct portion 52 is combined with the flow of dust laden air in the first duct portion 50.

A vane-type axial fan assembly 70, similar to the fan assembly 64, may also be positioned within the second duct portion 52 closely adjacent the inlet 60 or alternatively removed from the duct portion 52 and positioned oppositely of the inlet 60 on the machine frame 12. It should be understood that the fan assembly 64 is operable to induce flow of dust laden air into the second duct portion 52 so that operation of the fan assembly 70 is not essential to induce airflow into the second duct portion 52 and through the crossover duct portion 54 to the first duct portion 50. Further, fan assembly 70 in the second duct portion 52 may be operated with the fan assembly 64 in the first duct portion 50 removed from operation. In this embodiment, the fan assembly 70 generates flow of dust laden air from the second duct portion 52 and crossover duct 54 into the first duct portion 50, which, in turn, creates a venturi effect in the upstream portion of the first duct portion 50 to draw air into the inlet 56 and through the first duct portion 50.

The flow of dust laden air through the first duct portion 50 in the direction of arrow 66 is combined with the flow of dust laden air from the crossover duct portion 54 in the direction of arrow 72 for flow to the duct outlet 58 in the direction of arrow 74. Upstream of the outlet 58 within the passageway of the duct portion 50 is positioned a dust removal apparatus generally designated by the numeral 76 in FIG. 3. Dust removal apparatus 76 includes a flooded bed-type scrubber 78 positioned in the duct passageway upstream of a demister 80. The combination scrubber 78 and demister 80 are conventional in design and are illustrated in greater detail in FIGS. 4 and 5. The scrubber 78 injects a liquid spray into the duct passageway toward the outlet 58 in the flow path of the dust laden air. Nozzles direct a high velocity liquid spray in the direction of airflow through the duct portion 50. A portion of the dust particles in the airflow are combined with the liquid to form a slurry which is removed from the airflow.

The dust particles mixed with the high velocity spray remaining in the airflow are encapsulated in the liquid and are carried by the liquid spray and airflow into the demister 80. The demister 80 is operable to remove the combined liquid and dust as a slurry from the airflow through the demister. From the demister 80, the air is discharged from the first duct portion 50 through outlet 58 substantially free of dust particles. The slurry of liquid and dust particles is discharged from the scrubber 78 and demister 80 onto the conveyor 20 and is carried with the dislodged material to the conveyor discharge end portion 26.

As illustrated in FIG. 3, an exhaust or discharge duct portion 82 is connected to the first duct portion 50 at the outlet 58. The discharge duct portion 82 extends transversely on the mining machine frame to the opposite side of the machine to an exhaust or discharge outlet 84. This arrangement permits cleaned air to be discharged rearwardly from the mining machine on the opposite side of the outlet 58. This arrangement permits the cleaned air to be selectively discharged from either side of the machine frame 12, for example, from the outlet 58 associated with the first duct portion 50 or the outlet 84 by operation of pivotal gates 86 and 88, shown in detail in FIG. 3.

As illustrated in FIGS. 1 and 2, the discharge duct portion 82 extends transversely across the machine frame 12 and beneath the operator's compartment 30. In an alternative arrangement, the discharge duct portion 82 is positioned to extend rearwardly from the frame rearward end portion 18. This has the effect of adding to the overall length of the mining machine frame 12. In those applications where it is desired to minimize the overall length of the frame 12, extending the discharge duct portion 82 beneath the operator's compartment 30 is preferred because it does not increase the length of the frame 12 by the provision of the dust collecting device 48. However, in those applications where lengthening of the machine frame 12 by provision of the dust collecting device 48 is not critical, the discharge duct portion 82 may be positioned rearwardly of the frame 12.

The overall length of the dust collecting device 48 is also reduced by locating the fan assemblies 64 and 70 adjacent to the inlets 56 and 60 of the first and second duct portions 50 and 52. Conventionally, fan assemblies of a dust collecting system on a mining machine are positioned rearwardly on the machine frame in the duct passages. This requires the rearward portion of the duct passages to be increased in length to accommodate the fan assemblies in addition to the scrubber and demister. This problem is avoided with the present invention by positioning the fan assemblies 64 and 70 at the inlets 56 and 60 to the duct passageways 50 and 52. Also the forward positioning of the fan assemblies 64 and 70 makes them more accessible for maintenance purposes and reduces the noise level exposed to the operator in the compartment 30.

In both applications where the discharge duct portion 82 is positioned to extend beneath the operator's compartment 30 or project rearwardly from the frame rearward end portion 18, gates 86 and 88 are operated to provide selective discharge of the cleaned air from outlet 58 on one side of the machine or from outlet 84 on the opposite side of the machine. When it is desired to discharge the cleaned air from the outlet 58, the gate 86 is pivoted to a position in the exhaust duct portion 82 to direct airflow from the first duct portion 50 through the outlet 58 and prevents airflow from entering the discharge duct portion 82.

In the alternative, when it is desired to exhaust the cleaned air from discharge outlet 84 on the opposite side of the machine, the gate 86 is pivoted to a position to close the outlet 58 from the flow of air and divert the airflow through the discharge duct portion 82 to the discharge outlet 84. The gate 88 is pivoted to a position opening the outlet 84. A suitable control mechanism (not shown) is provided for the coordinated movement of the gates 86 and 88 to provide selective discharge of the cleaned air from either side of the machine.

Figure 4:
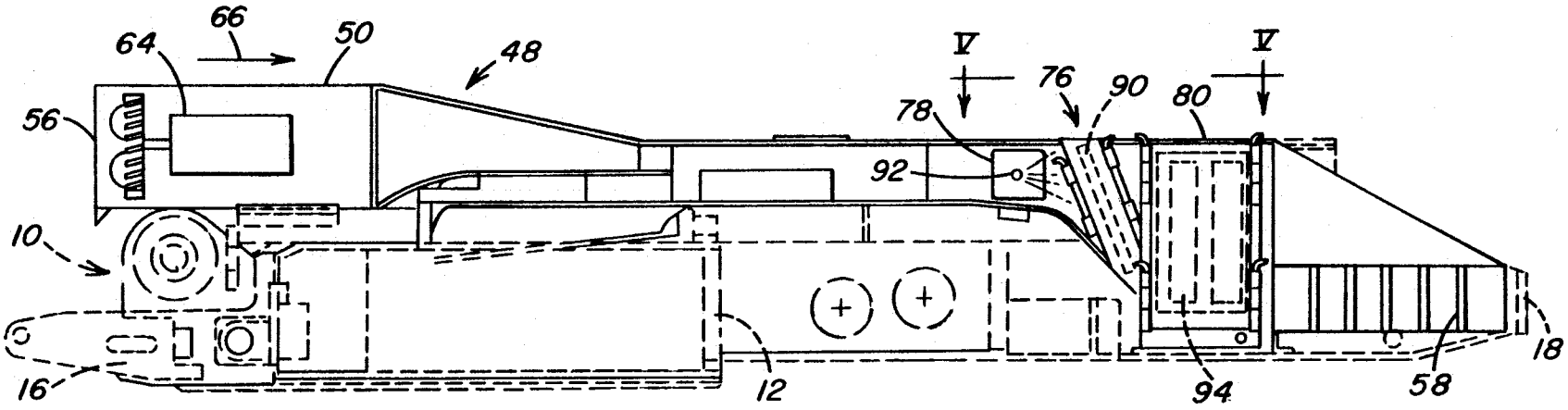
FIG. 4 is a view in side elevation of the dust collecting system shown in FIG. 3, illustrating a fan at an intake end of the duct and a combination scrubber and demister adjacent to the exhaust end of the duct.
Figure 5:
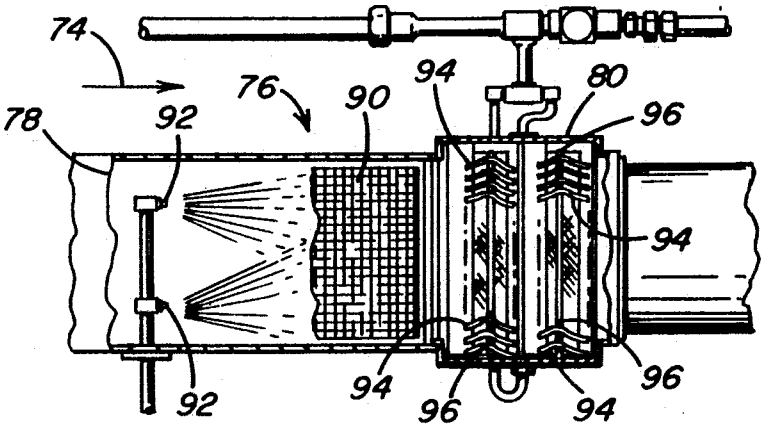
FIG. 5 is an enlarged fragmentary top plan view taken along line V—V of FIG. 4, illustrating the scrubber and demister for removing dust particles from the airflow.

Now referring to FIGS. 4 and 5, there is illustrated in greater detail the structure of the scrubber 78 and demister 80. Preferably, the scrubber 78 is a flooded bed-type scrubber that includes a bed 90 of a plurality of layers of open mesh material, such as cloth wire, held between reinforcing frames. As known in the art, the cloth wire does not cause an undue pressure drop in the first duct portion 50. The scrubber 78 is positioned upstream of the demister 80 in the first duct portion 50. The scrubber 78 also includes a plurality of spray nozzles 92 that supply a continuous high velocity stream of liquid, such as water, onto the wire cloth bed 90. The liquid spray wets the bed 90.

The dust laden air flowing through the duct passageway 50 toward the outlet 58 is subjected to the water spray so that the airborne dust in the air is encapsulated within the water spray to form a slurry of liquid and dust particles. In this manner, the dust particles are removed from the airflow. Dust particles also impact the cloth wire bed 90 which is wetted by the liquid spray. The dust particles impacting the bed 90 are separated from the airflow and further become encapsulated within the liquid that forms droplets on the bed 90. Consequently, the dust particles become suspended in water droplets on the bed 90 and form a slurry which is directed from the bed 90 downwardly onto the conveyor 20 for mixture with the dislodged material thereon.

The portion of the dust encapsulated water spray that passes through the cloth wire bed 90 and remains in the airflow is removed by the demister 80. The demister 80 separates the remaining water encapsulated dust particles from the airflow. The demister 80 includes a plurality of curved parallel vanes or louvers 94. The louvers 94 extend vertically in the duct passageway and generally parallel to the direction of airflow. Each vane 94 has a hook-shaped rib 96 opening upstream and extending the length of the vane 94.

The dust containing water droplets impact the vanes 94 and are separated from the air that continues to flow through the passageways in the demister 80 formed by the vanes 94. The dust containing water droplets then flow downwardly on the surface of the vanes 94 and collect beneath the demister 80. The slurry of liquid and dust particles are directed to the conveyor 20. It should be understood that the scrubber 78 and demister 80 are conventional in design. An example of a combination scrubber and a demister suitable for use in the present invention are illustrated and described in U.S. Pat. No. 4,380,353.

From the demister 80 the airflow continues in the first duct portion 50 toward the outlet 58 in the discharge duct portion 82. Depending on the side from which the air substantially free of dust is to be directed, the gates 86 and 88 are pivoted to their desired positions. By positioning the discharge duct portion 82 on the machine frame 12 beneath the operator's compartment 30, selective discharge of the cleaned air from either side of the mining machine is accomplished without increasing the overall length of the mining machine.

In operation, the mobility of the mining machine 10 is severely restricted by the limited confines of an underground mine. Consequently, the mining machine 10 is compactly constructed to allow for maximum mobility of the machine in the mining operation. The addition of equipment on the machine which decreases its mobility, such as increasing the length of the machine, is avoided as much as possible. Adding to the length of the mining machine by the addition of a dust collecting device that includes a discharge duct portion extending from the rearward end portion of the machine reduces to extend the maneuverability of the mining machine in an underground mine.

In accordance with the present invention, the dust collecting system 48 does not contribute to a reduction in the maneuverability of the mining machine 10 by adding to the overall length of the machine. By positioning the discharge duct portion 84 beneath the operator's compartment 30, ventilating equipment is not required to extend rearwardly of the machine frame 12, which would otherwise tend to impede the ability of the machine to maneuver in the close quarters of an underground mine passage. The dust collecting system 48 of the present invention removes the discharge duct portion 82 from the rearmost portion of the frame 12 and moves it forwardly onto the frame 12 and beneath the operator's compartment 30. This has the effect of shortening the overall length of the machine frame 12. A principal advantage achieved by this construction is the provision of a shorter turning radius for the mining machine which is another critical factor in underground mining operations.

Also as discussed above, by moving the fan assemblies 64 and 70 from where they are conventionally positioned in a dust collecting system at the rearward end portion of the mining machine to the forward end portion thereof contributes to the shortening of the overall machine length. Positioning the fan assemblies 64 and 70 adjacent the duct inlets 56 and 60 relocates the fan assemblies from where they are conventionally positioned adjacent to the operator's compartment 30. The fan assemblies 64 and 70 contribute to the overall noise in the operation of the mining machine. By positioning the fan assemblies at considerable distance from the operator's compartment 30, the noise level in the operator's compartment 30 is substantially reduced. A reduction in the noise level is an obvious safety advantage in underground mining.

According to the provisions of the patent statutes, I have explained the principle, preferred construction, and mode of operation of my invention and have illustrated and described what I now consider to represent its best embodiments. However, it should be understood that within the scope of the appended claims, the invention may be practiced otherwise than as specifically illustrated and described.

I claim:

1. A mining machine comprising, a mobile frame having a front end portion and a rearward end portion, dislodging means mounted on said mobile frame front end portion for dislodging material from a mine face, conveying means positioned on said mobile frame for conveying dislodged material rearwardly of the mine face, duct means extending longitudinally on the mobile frame and laterally of said conveying means for directing a flow of airborne dust from said front end portion to said rearward end portion, said duct means having an inlet adjacent to said front end portion and outlet adjacent to said rearward end portion, a fan assembly mounted on said mobile frame and positioned adjacent to said duct means inlet and operable to induce flow of airborne dust through said duct means from said inlet to said outlet, and collection means for removing dust from the flow of airborne dust through said duct means, said collection means separated from said fan assembly by an extended length of said duct means and positioned on said mobile frame adjacent to said outlet so that air is discharged from said duct means substantially free of airborne dust.

2. A mining machine as set forth in claim 1 which includes, second duct means positioned on said mobile frame oppositely of said duct means for receiving a flow of airborne dust at said frame front end portion, said second duct means having an inlet adjacent to said frame front end portion, and a crossover duct extending across said frame from said second duct means to said duct means between said inlet and said outlet thereof to direct the flow of airborne dust from said second duct means to said duct means.

3. A mining machine as set forth in claim 2 which includes, a second fan assembly mounted on said mobile frame and positioned adjacent to said second duct means inlet to induce flow of airborne dust into said second duct means and through said crossover duct to said first mentioned duct means for mixture with airborne dust therein between said fan assembly and said collection means.

4. A mining machine as set forth in claim 2 in which, said crossover duct is connected in fluid communication with said first mentioned duct means and said second duct means, and said crossover duct being connected to said first mentioned duct means at a selected point between said fan assembly and said collection means.

5. A mining machine as set forth in claim 1 in which, said collection means includes a combination scrubber and demister positioned in said duct means adjacent to said outlet, and said scrubber being positioned in said duct means upstream of said demister.

6. A mining machine as set forth in claim 1 which includes, a discharge duct connected to said frame rearward end portion and having one end portion connected to said duct means outlet on one side of said frame and a discharge outlet positioned on the opposite side of said frame, and means positioned in said discharge duct for selectively controlling the discharge of air substantially free of airborne dust from said duct means outlet on one side of said frame and said discharge outlet on the opposite side of said frame.

7. A mining machine as set forth in claim 6 which includes, a first control gate pivotally mounted in said discharge duct at said duct means outlet for movement between a first position blocking airflow through said discharge duct and directing airflow to said duct means outlet and a second position blocking airflow through said duct means outlet and directing airflow through said discharge duct, and a second control gate pivotally mounted in said discharge duct at said discharge outlet for movement between a first position blocking airflow through said discharge outlet when said first control gate is in said first position and a second position directing airflow through said discharge outlet when said first control gate is in said second position.

8. A mining machine as set forth in claim 6 in which, said discharge duct extends transversely relative to said conveying means on said frame and is positioned on said frame forwardly of said frame rearward end portion.

9. A mining machine as set forth in claim 8 which includes, an operator's compartment positioned on said frame at said rearward end portion thereof, and said discharge duct extending beneath said operator's compartment on said frame to said discharge outlet being positioned adjacent to and underlying said operator's compartment.

10. A mining machine as set forth in claim 6 in which, said discharge duct extends transversely relative to said conveying means on said frame and is connected to extend rearwardly of said frame rearward end portion.

11. A method for removing airborne dust from a mine face during a mining operation comprising the steps of, dislodging material from a mine face, conveying the dislodged material rearwardly from the mine face on a mining machine, positioning a duct system on the mining machine to extend longitudinally from an inlet adjacent to the mine face to an outlet adjacent to a rearward portion of the mining machine, mounting a fan on the mining machine adjacent to the inlet to the duct system, mounting a scrubber device on the mining machine in a position removed from the fan by an extended length of the duct system adjacent to the outlet to the duct system, conveying dust laden air longitudinally on the mining machine through the duct system from the inlet to the outlet and laterally of the dislodged material conveyed on the mining machine, separating dust particles from the flow of air in the scrubber device, collecting the dust particles on the mining machine for disposal, and discharging from the scrubber device the air substantially free of dust particles.

12. A method as set forth in claim 11 which includes, positioning a second duct system on the mining machine with an inlet adjacent to the mine face, extending the second duct system in parallel relation to and on the opposite side of the mining machine of the first mentioned duct system, connecting the second duct system to the first mentioned duct system at a point between the inlet and the outlet thereof, and directing the flow of airborne dust from the second duct system across the mining machine to the first mentioned duct system and therefrom to the outlet thereof.

13. A method as set forth in claim 12 which includes, mounting a second fan on the mining machine adjacent to the inlet of the second duct system, and inducing flow of airborne dust by the second fan into the inlet of the second duct system and through the second duct system into the first mentioned duct system.

14. A method as set forth in claim 11 which includes, connecting the outlet of the duct system to a discharge duct extending transversely across the mining machine to a discharge outlet, and selectively discharging the air substantially free of dust particles from the outlet of the duct system and the discharge outlet of the crossover duct.

15. A method as set forth in claim 14 which includes, positioning the discharge duct at the rearward portion of the mining machine transversely to a longitudinal conveyor thereon, and extending the discharge outlet beneath an operator's compartment on the mining machine.

16. A method as set forth in claim 14 which includes, positioning the discharge duct rearwardly of the mining machine rearward end portion, and extending the discharge duct transversely across the mining machine rearward end portion.

17. A dust collecting system on a mining machine comprising, a machine frame having a front end portion and a rearward end portion, means carried at said frame front end portion for dislodging material from a mine face, means for gathering and conveying the dislodged material rearwardly on said machine frame, a first duct assembly positioned on one side of said machine frame to extend from said front end portion to said rearward end portion, an intake end of said first duct assembly located adjacent to said front end portion, an exhaust end of said first duct assembly located adjacent to said rearward end portion, a first fan positioned on said machine frame adjacent to said intake end for inducing a flow of dust laden air into said first duct assembly and directing said flow therethrough to said exhaust end, scrubber means positioned at said frame rearward end portion for receiving the flow of dust laden air adjacent to said exhaust end and separating dust particles from the flow of air for discharge of the air substantially free of dust particles from the exhaust end, a second duct assembly positioned on an opposite side of said machine frame, said second duct assembly having an intake end located adjacent to said front end portion, a crossover duct assembly connecting said first and second duct assemblies, and said crossover duct assembly extending transversely on said machine frame from said second duct assembly to said first duct assembly between said intake end and said exhaust end thereof so that the flow of dust laden air through said first duct assembly induces flow of dust air laden into said second duct assembly and through said crossover duct assembly into said first duct assembly.

18. A dust collecting system as set forth in claim 17 which includes, a discharge duct extending transversely relative to said machine frame, and said discharge duct having one end connected in fluid communication with said first duct assembly exhaust end and an opposite end portion positioned on the opposite side of said machine frame for discharge of air substantially free of dust particles therefrom.

19. A dust collecting system as set forth in claim 18 which includes, airflow control means positioned in said discharge duct for directing the flow of air substantially free of dust particles to a selected one of said first duct assembly exhaust end and said discharge duct opposite end portion.

20. A dust collecting system as set forth in claim 18 which includes, an operator's compartment positioned on said frame at said rearward end portion, and said discharge duct being positioned on said frame and extending beneath said operator's compartment.

21. A mining machine comprising, a mobile frame having a front end portion and a rearward end portion, dislodging means mounted on said mobile frame front end portion for dislodging material from a mine face, conveying means positioned on said mobile frame for conveying dislodged material rearwardly of the mine face, first duct means extending longitudinally on the mobile frame for directing a flow of airborne dust from said front end portion to said rearward end portion, said first duct means having an inlet adjacent to said front end portion and outlet adjacent to said rearward end portion, a fan assembly mounted on said mobile frame and positioned adjacent to said first duct means inlet and operable to induce flow of airborne dust through said first duct means from said inlet to said outlet, collection means for removing dust from the flow of airborne dust through said first duct means, said collection means positioned on said mobile frame adjacent to said outlet so that air is discharged from said first duct means substantially free of airborne dust, second duct means positioned on said mobile frame for receiving a flow of airborne dust at said frame front end portion oppositely of said first duct means, said second duct means having an inlet adjacent to said frame front end portion, and a crossover duct extending across said frame from said second duct means to said first duct means between said inlet and said outlet thereof to direct the flow of airborne dust from said second duct means to said first duct means.

22. A mining machine comprising, a mobile frame having a front end portion and a rearward end portion, dislodging means mounted on said mobile frame front end portion for dislodging material from a mine face, conveying means positioned on said mobile frame for conveying dislodged material rearwardly of the mine face, duct means extending longitudinally on the mobile frame for directing a flow of airborne dust from said front end portion to said rearward end portion, said duct means having an inlet adjacent to said front end portion and outlet adjacent to said rearward end portion, a fan assembly mounted on said mobile frame and positioned adjacent to said duct means inlet and operable to induce flow of airborne dust through said duct means from said inlet to said outlet, collection means for removing dust from the flow of airborne dust through said duct means, said collection means positioned on said mobile frame adjacent to said outlet so that air is discharged from said duct means substantially free of airborne dust, a discharge duct connected to said frame rearward end portion and having one end portion connected to said duct means outlet on one side of said frame and a discharge outlet positioned on the opposite side of said frame, means positioned in said discharge duct for selectively controlling the discharge of air substantially free of airborne dust from said duct means outlet on one side of said frame and said discharge outlet on the opposite side of said frame, a first control gate pivotally mounted in said discharge duct at said duct means outlet for movement between a first position blocking airflow through said discharge duct and directing airflow to said duct means outlet and a second position blocking airflow through said duct means outlet and directing airflow through said discharge duct, and a second control gate pivotally mounted in said discharge duct at said discharge outlet for movement between a first position blocking airflow through said discharge outlet when said first control gate is in said first position and a second position directing airflow through said discharge outlet when said first control gate is in said second position.

* * * * *